United States Patent [19]

Catelli

[11] Patent Number: 4,489,769

[45] Date of Patent: Dec. 25, 1984

[54] CONTINUOUS-CYCLE ASEPTIC FILLING MACHINE

[75] Inventor: Camillo Catelli, Parma, Italy

[73] Assignee: Rossi & Catelli S.p.A., Parma, Italy

[21] Appl. No.: 381,706

[22] Filed: Aug. 25, 1982

[30] Foreign Application Priority Data

Jul. 16, 1981 [IT] Italy ..... 40077 A/81

[51] Int. Cl.[3] ..... B65B 3/04

[52] U.S. Cl. ..... 141/91; 141/146; 141/258

[58] Field of Search ..... 141/1-12, 141/85-92, 129-191; 426/399, 250-284

[56] References Cited

U.S. PATENT DOCUMENTS 4,024,896 5/1977 Ishioka et al. ..... 141/91

*Primary Examiner*—Houston S. Bell, Jr.

*Attorney, Agent, or Firm*—Darby & Darby

[57] ABSTRACT

A continuous-cycle filling-machine for aseptic batching comprises a revolving basin whose floor exhibits a plurality of open-topped cylinders communicating therewith and accommodating respective sliding plungers designed to expel contents of the cylinder toward a filler-jig. A fixed obturator is in direct contact with the basin-floor under which the cylinders are brought to bear by rotation of the basin during the delivery-stroke. An annular chamber located externally and beneath the basin communicates with a source of sterilizer fluid by way of a feed-conduit within the shaft around which the basin rotates. An outer-casing has a bottom-face at least part-created by the basin-floor and an interior which receives slightly-pressurized fluid. Sterile conditions are thus maintained within the machine. Lifting gear is provided for raising the obturator from the basin-floor at will.

8 Claims, 4 Drawing Figures

CONTINUOUS-CYCLE ASEPTIC FILLING MACHINE

BACKGROUND OF THE INVENTION

The invention described herein is an aseptic filling machine intended for continuous-cycle function.

Amongst known machinery utilized for bottling and canning fluid, paste, semi-stiff and lumpy foodstuffs, one type basically comprises a single revolving basin at whose bottom a plurality of open-top cylinders—located so as to communicate directly therewith—accommodate respective plungers designed to expel whatever substance happens to lie within the cylinder in the direction of a filling jig. Vertical motion of these plungers is brought about by a guide, or plate, located beneath the plungers and engaging the lower, running extremities thereof during rotation of the machine. The guide is circular, and inclined so as to produce raising and lowering of the plunger-end, —hence of the plunger.

Machines of this type further comprise a fixed obturator placed in direct contact with the basin-floor and occupying part of an annular and coronary element in the basin itself. Underneath, cylinders are brought to an operating position one by one by rotation of the basin in readiness for the stroke which displaces the substance therefrom; once the cylinders revert to suction, they move into an area unaffected by the obturator. In this fashion, the suction stage causes foodstuff to drop into the individual cylinders whilst the delivery or expulsion stage causes the same substance—not able to escape from the upper part of the cylinder by virtue of the obturator's presence—to be directed to filling-jigs which batch the same into containers.

These machines are capable of batching into various sizes of container. It suffices to move the guide aforesaid upward or down with respect to the revolving basin in order to diminish or increase the plunger-stroke and, as a result, the cylinder displacement.

Up to the present time, machines of the type thus described have not been able to carry out such batching into containers under aseptic conditions.

One advantage of the invention described herein is that of enabling container-filling under aseptic conditions as well as easily-controlled batching of the foodstuff by the machine into containers.

A further advantage offered by the machine is that of permitting both easy cleaning thereof and a reduction in frequency of servicing and maintenance operations thereon.

Another advantage of the machine described herein is that of ensuring a greater functional reliability.

SUMMARY OF THE INVENTION

These and other advantages are offered by the machine to which the invention relates, being of the type comprising a revolving basin whose floor exhibits a plurality of open-top cylinders located in direct communication therewith and accommodating respective sliding plungers designed to expel whatever substance happens to lie within the cylinder in the direction of a filler-jig. A fixed obturator is placed in direct contact with the basin-floor whereunder the cylinders are brought at regular intervals by rotation of the basin when in the process of expelling foodstuff. The machine is characterized in that it comprises:

an enclosed annular chamber located externally of the basin and affixed thereto whilst communicating with an independent source of sterilizing fluid by way of a feed conduit. The feed conduit is located coaxially within a shaft and turns with the basin. The chamber communicates further with a plurality of annular cavities located individually upon respective outer surfaces of plungers. An outer casing within which marginally-pressurized sterile fluid is introduced is provided to the end of maintaining a sterile atmosphere within the machine, and the lower surface of the revolving basin constitutes at least a portion of the bottom face of the casing and is united with the stationary remainder thereof by rotary seals.

BRIEF DESCRIPTION OF THE DRAWINGS

Further features and advantages of the invention described herein will emerge more clearly from the detailed description of a preferred though not exclusive form of embodiment which follows, illustrated as a strictly unlimitative example with the aid of accompanying drawings, in which.

DESCRIPTION OF THE PREFERRED EMBODIMENT

Figure 1:
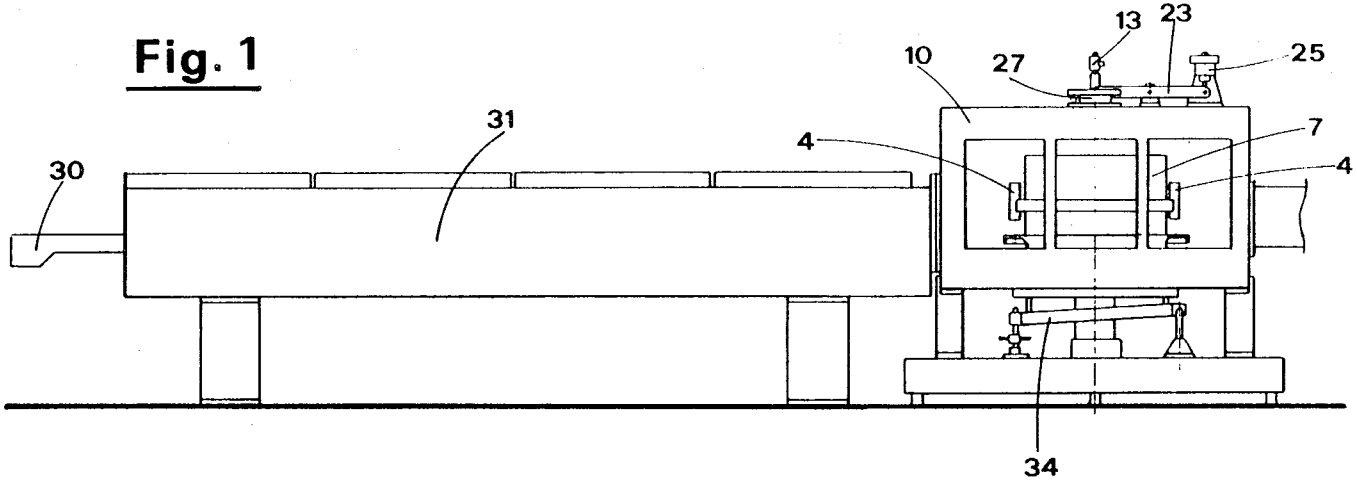
FIG. 1 is a vertical elevation of part of a canning/bottling plant into which the machine herein is incorporated.

The filling-machine, or batching-unit described herein is incorporated into a production line which comprises a conveyor 30 (FIGS. 1 and 2) whereon containers 36 (FIG. 3) for filling are arranged prior to entering a tunnel 31 inside which their sterilization is accomplished. An entry carrier-wheel 32 is then encountered by means whereof the containers 36 are taken up and deposited on the machine proper for the purpose of being filled. A given container 36 is positioned on the machine and caused to rotate therewith for almost one entire circumference during the course of which filling takes place.

The container thus filled is taken up by an exit carrier 33 providing for transfer to a further tunnel 43 wherein to be capped with presterilized tops, stoppers, etc., under sterile conditions.

The machine to which the invention relates comprises a revolving basin 1 (FIG. 3) whose floor exhibits a number of cylinders 2 possessed of open tops which communicate direct with the basin interior. A plunger 3 is housed within each cylinder. The sliding of the plunger 3 within the cylinder 2 serves to expel such foodstuff as occupies the cylinder 2 in the direction of a filler-jig 4 by way of a conduit 37.

The lower extremity 35 of each plunger issuing from a given cylinder is formed as a wheel and runs internally of a guide 34 of circular shape and inclined disposition—a cam to all intents and purposes. The plunger-extremities' ascent or descent upon the guide 34 determines the displacement and suction strokes completed by each plunger.

Variable degree of displacement produced by the individual plungers—hence variation in volume of foodstuff necessary to fill differing sizes of container—is obtained by adjusting the cylinder capacity through raising or lowering the guide 34. This diminishes or increases the plunger-stroke.

The batching or filler-jigs 4 are stationary with respect to the basin and therefore revolve as one therewith. The same is true of stands 38 upon which the containers are lodged during filling.

The basin 1 is also rigidly attached to a shaft 8 caused to rotate by drive means not indicated in the drawings.

The machine herein further comprises a fixed obturator 5 placed in direct contact with the basin floor by way. The block 39 has a a shoe or block 39 of shape corresponding to the portion of a coronary-cum-annular disk, beneath which the cylinders 2 are brought as described above. This obturates or closes off the open end of the cylinder 2 and enables expulsion of the foodstuff toward an associated filler jig 4.

Once having delivered up their contents, the cylinders 2 depart from block 39 and begin suction, the substance in basin 1 descending unhindered into the cylinder 2 interior by way of the open top thereof.

Figure 2:
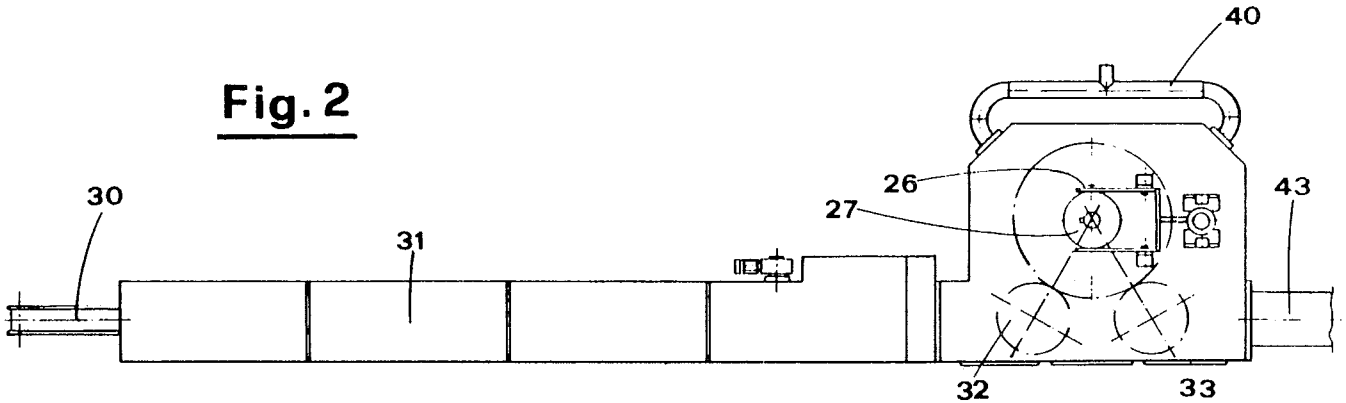
FIG. 2 is a view from above of the plant illustrated in FIG. 1.

The machine as illustrated is enclosed by an outer casing 10 into which slightly-pressurized sterile fluid is introduced by way of a pipeline 40 (FIG. 2). The lower surface of revolving basin 1 constitutes a portion of the outer casing 10 bottom-face, this surface being united by rotary seals—for instance a labyrinth type seal 11 (FIG. 3)—to the remaining stationary body of the casing 10. During machine function there is a slight leakage-out of sterile fluid from within via seal 11, though never the other way about by virtue of the fact that the fluid within the casing is pressurized marginally in excess of the surrounding external atmosphere.

The special structural form of casing 10 leaves the guide 34 and its means of adjustment outside the sterile zone, thus making for easy access to said means and simple and problem-free regulation of batching-volume into the foodstuff-containers.

The stationary portion of the casing bottom-face also presents a drainage-channel 22 affixed to side-walls of the actual outer-casing body. The precise function of the channel 22, which is furnished with a discharge outlet 41, will emerge as the description unfolds.

The machine described herein is equipped with an enclosed annular chamber 6 (FIG. 3) located externally of and revolving as one with basin 1, whose bottom 16 is inclined downward from the center away to the periphery thereof.

The chamber 6 connects with an external source of sterile fluid (not shown in the drawings) by way of a feed-conduit 7 located coaxially to and within the shaft 8. A seat 12 is formed at the top of the shaft 8 when it protrudes from the casing 10. The seat 12 houses the outlet port 14 of a stationary union 13 whose inlet port 15 is connected to the source of sterilizer fluid. Provision is made further for means by which to ensure a tight seal between the union 13 and seat 12 during rotation of the latter. The sealing means comprises O-rings lodged in grooves sunk into the surface of the seat 12 or union 13, for instance. In this way, sterilizer from the source may reach the chamber 6 during rotation of the basin without encountering any special difficulty.

Figure 4:
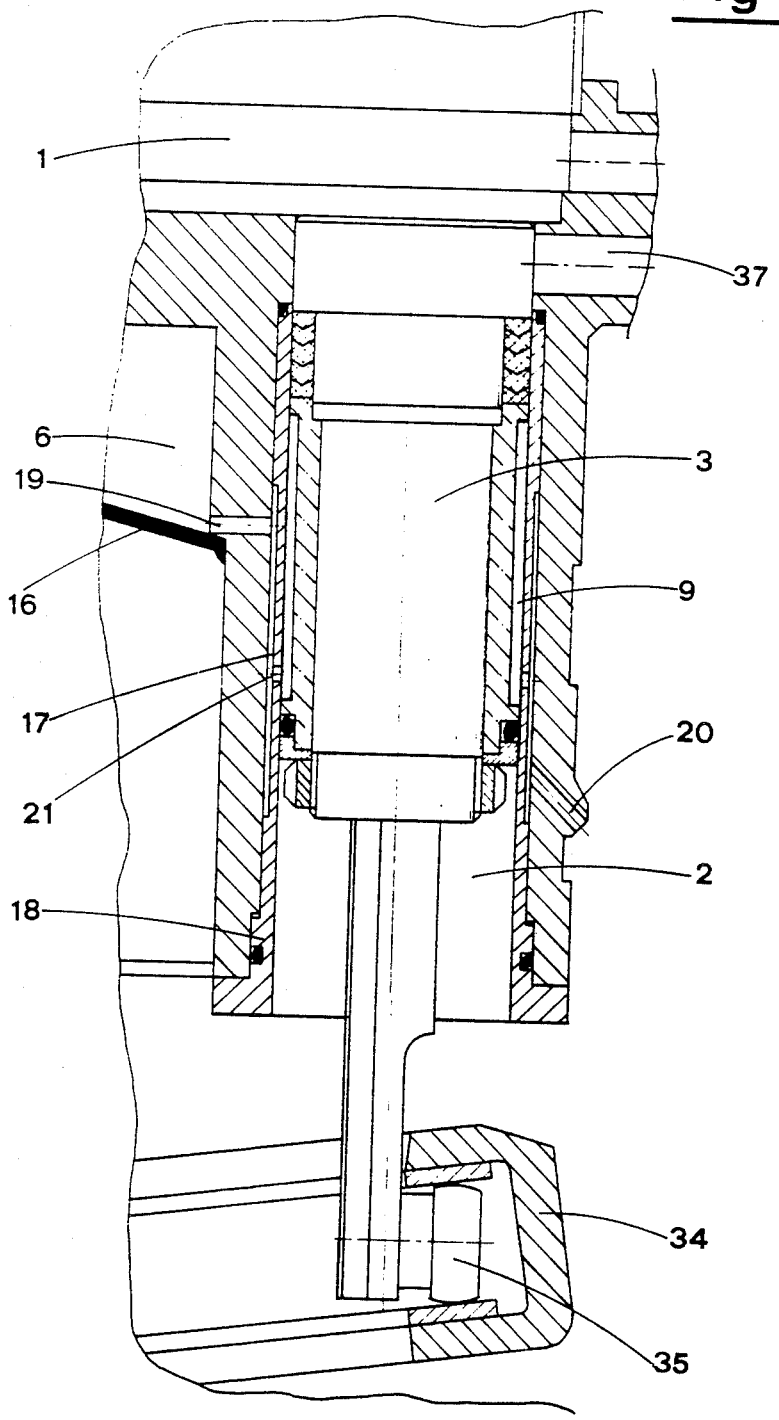
FIG. 4 is a larger-scale section through one of the cylinders in the machine, seen in vertical elevation and demonstrating its position at the point of commencing suction.

The liner 18 (FIG. 4) of each individual cylinder has an internally-located jacket 17, whilst an annular cavity 9 is located about the outside surface of each plunger.

Each annular cavity 9 communicates with its associated jacket 17 by way of connecting-bores 21; each jacket connects with annular chamber 6 through a duct 19.

With this arrangement, fluid within chamber 6 may pass easily into each of annular cavities 9.

The length of the annular cavities and the positioning of the associated connecting bores are such that the bore communicates with the annular cavity regardless of the plunger-position with respect to its associated cylinder. There is thus unbroken communication between annular chamber 6 and each of annular cavities 9. Furthermore, each of the jackets 17 connects with the zone surrounding the basin by way of an outlet duct 20. Sterile fluid coming from chamber 6—whether vapor, condensate, chlorine or other suitable fluid agent—is thus able to envelop each plunger continually and prevent any air with possible attendant contamination from penetrating the sterile zone created in the machine.

Figure 3:
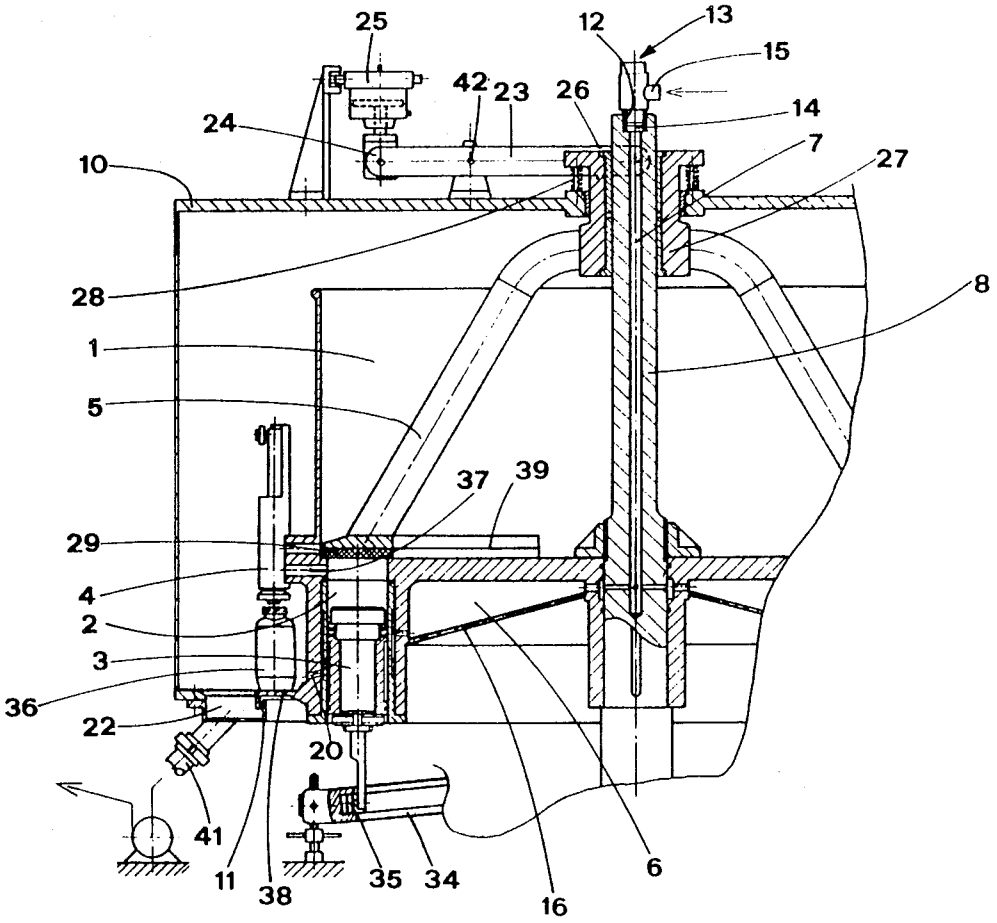
FIG. 3 is an axial section through part of the machine described herein.

Fluid circulating within each jacket and cavity is able to flow out through duct 20 to the area surrounding basin 1 where it then collects in the channel 22—clearly visible in FIG. 3—before being taken out through discharge 41. This ensures a constant renewal of sterilizer fluid.

The machine further comprises lifting gear located externally of outer-casing 10 designed to raise the obturator 5 at will, in such a way that the block 39 separates from the basin-floor.

The lifting gear comprises a lever-arm 23 located above the upper face of outer-casing 10 and pivoting about a fixed axis 42; one emtremity 24 of the lever-arm 23 is in direct receipt of motion produced by a jack 25 whilst the remaining yoked extremity 26 hinges with a collar 27. The collar 27 and obturator 5 are rigidly connected together and capable of sliding in a vertical direction with respect to the upper face of outer-casing 10; the collar 27 also accommodates the extremity of the shaft 8 which issues from the casing 10 and carries the union 13, in such a way as to permit both sliding and rotation thereof.

Further non-rigid means such as a coil spring assembly 28 is provided whereby inadvertent raising of the collar 27 with respect to the casing is prevented. This also prevents inadvertent raising of the block 39 with respect to the basin.

By working jack 25 so as to depress lever-arm extremity 24, the other lever-extremity 26 will rise and duly lift with it both the collar 27 and the obturator 75 as one. Thus the block 39 will be separated from the basin-floor.

Once the jack ceases functioning, both the collar 27 and the lever-arm 23 will be returned to their original positions by return springs 28; the springs 28 serves, moreover, to prevent unintended raising of the obturator 5—hence of the block 39—during machine function.

The surface of the obturator 5 coming into contact with the basin-floor is embodied in the form of a layer 29 of lower friction material intended to reduce wear occasioned by continuous rubbing together of two contact surfaces. During machine function the obturator 5 remains in permanent contact with the floor of basin 1; friction generated between these two is kept to a minimum however, as foodstuff present within the basin performs the role of lubricant by entering between the two contact surfaces.

A continuous flow of sterilizer through feedconduit 7 primes chamber 6 and therefore maintains jackets and cavities in each of the cylinders and plungers in a similar state. Such fluid as flows out through ducts 20 accumulates in channel 22 and is duly evacuated therefrom.

The presence of sterilizer fluid as described thus prevents any influx of contaminating outside air or polluting particles into the machine sterile zone by way of the cylinder walls. By the same token, distribution of sterilizer to the cylinders is extremely simple in that none of the parts through which the fluid passes is subject to inter-related motion, with the exception of the seat 12 in shaft 8 which revolves about union 13. In this particular area of the machine it is a simple matter to seal such a joint effectively, as will be clear from the description foregoing.

As previously stated, there is a slight escape of sterilizer from within to the outside through the labyrinth seal 11—never the other way about. Thus, as long as the machine is functioning, sterile conditions created within the machine are maintained constant.

In the event of the machine being emptied of foodstuff for the purposes of cleaning, or whenever pre-sterilization must be carried out prior to the commencement of a fresh production cycle, the machine itself will be washed out with either appropriate cleansing agents or sterilizer in order to obtain the initial aseptic state. Operations of the kind must in fact be carried out with the machine running if all parts thereof are to be thoroughly cleansed and/or sterilized; indeed it would be impossible to clean the machine effectively when at standstill as cylinders lying beneath the obturator block would not be reached by the cleansing agent or sterilizing fluid.

During cleaning the jack 25 is operated to raise the obturator 5 thereby enhancing the cleaning itself, but also preventing friction between obturator and basin-floor which would result if these two were left in contact during a cleaning run with no foodstuff present within the basin to serve as lubricating agent.

The layer 29 need not be replaced over-frequently, as any wear produced by the machine's running empty—far greater than that produced during normal service—is altogether avoided by virtue of lifting gear described which separates contact surfaces between obturator and basin whenever the machine has to run empty.

Numerous modifications of a practical nature may be made to constructive details of the invention without by any means straying from within bounds of protection afforded to the basic concept as defined by supporting claims.

What is claimed:

1. Continuous-cycle aseptic filling machine comprising a filler jig; a rotatable basin having a floor; a plurality of open-topped cylinders in said floor located in direct communication therewith; a plurality of plungers respectively slidably mounted in said cylinders and designed to expel whatever substance happens to lie within said cylinders in the direction of said filler-jig; and a fixed obturator placed in direct contact with the basin-floor whereunder said cylinders are brought at regular intervals by rotation of the basin when in the process of expelling foodstuff, characterized in that it comprises:

an enclosed annular chamber located externally of said basin and affixed thereto, a shaft rotatable with said basin, an external source of sterilizer fluid, a feed conduit located coaxially within said shaft, said feed conduit communicating between said annular chamber and said external source, said chamber communicating further with a plurality of annular cavities individually located about respective outer surfaces of said plungers; and an outer casing within which marginally-pressurized sterile fluid is introduced to the end of maintaining a sterile atmosphere within said machine, the lower surface of said rotating basin constituting at least a portion of the bottom face of said casing, and rotary seals uniting said portion of the bottom face with the stationary remainder thereof.

2. Machine according to claim 1 characterized in that the said feed-conduit is located internally of said shaft, further comprising a seat at the uppermost extremity of said shaft, a stationary union having an inlet port and an outlet port, said seat housing said outlet port and said inlet port connecting with said source of sterilizer fluid; and means whereby a tight seal is ensured between said union and said seat during rotation of the latter with respect to said union.

3. Machine according to claim 1 wherein each cylinder includes a liner, further comprising a jacket located within said liner, a duct by which said jacket communicates with said annular chamber, an outlet duct by which said jacket communicates with the area surrounding said basin; at least one connecting bore connecting each jacket with said respective annular cavities; the length of each annular cavity and the positioning of said connecting-bore being such that the latter communicates continuously with said annular cavity regardless of the plunger-position with respect to its cylinder.

4. A machine according to claim 1 characterized by the fact that the bottom of said annular chamber is inclined downward from the center away to the periphery thereof.

5. Machine according to claim 1 characterized in that it comprises a drainage channel located peripherally of the bottom of said outer-casing and made fast to said outer casing.

6. Machine according to claim 1 characterized in that it comprises lifting gear located externally of said outer-casing and designed to raise said obturator at will, and in such a way as to separate same from the basin-floor.

7. Machine according to claim 6 characterized in that the said lifting gear comprises a jack, a collar rigidly connected to said obturator and capable of sliding in a vertical direction with respect to the upper face of said outer casing, a lever-arm located above the upper-face of said outer-casing and pivoted about a fixed axis, one of whose extremities being in receipt of motion direct from said jack whilst the remaining extremity hinges with said collar, an extremity of said shaft issuing from the casing and said collar accommodating said extremity in such a way as to permit both sliding and rotation thereof; and means for precluding inadvertent raising of said collar with respect to said casing.

8. Machine according to claim 1 characterized in that the surface of said obturator making contact with the basin floor is a layer of low-friction material.

* * * * *